US006211830B1

(12) United States Patent
Monma et al.

(10) Patent No.: US 6,211,830 B1
(45) Date of Patent: Apr. 3, 2001

(54) RADIO ANTENNA DEVICE

(75) Inventors: Kenji Monma, Neyagawa; Toshimitsu Matsuyoshi, Katano; Koichi Ogawa, Hirakata; Yoshio Koyanagi, Ebina, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/485,417

(22) PCT Filed: Jun. 8, 1999

(86) PCT No.: PCT/JP99/03059

§ 371 Date: Feb. 10, 2000

§ 102(e) Date: Feb. 10, 2000

(87) PCT Pub. No.: WO99/65108

PCT Pub. Date: Dec. 16, 1999

(30) Foreign Application Priority Data

Jun. 10, 1998 (JP) ..... 10-162059
Mar. 30, 1999 (JP) ..... 11-088658

(51) Int. Cl.[7] ..... H01Q 1/24

(52) U.S. Cl. ..... 343/702; 343/725; 343/749; 343/895

(58) Field of Search ..... 343/702, 725, 343/729, 749, 750, 751, 850, 852, 853, 860, 895; H01Q 1/24, 9/00, 1/36

(56) References Cited

U.S. PATENT DOCUMENTS 4,494,120 * 1/1985 Garay ..... 343/702
5,293,172 * 3/1994 Lamberty et al. ..... 343/701
5,865,390 * 2/1999 Iveges ..... 242/375
5,977,917 * 11/1999 Hirose ..... 343/702

FOREIGN PATENT DOCUMENTS 860 897 A1 8/1998 (EP) .
WO98/11625 3/1998 (WO) .

* cited by examiner

*Primary Examiner*—Tho Phan
(74) *Attorney, Agent, or Firm*—Wenderoth, Lind & Ponack, LLP.

(57) ABSTRACT

A radio antenna is disclosed with improvement in a radiation efficiency obtained by changing a directivity pattern of an antenna toward a direction not interfered by an obstacle and thus reducing radio wave interference by the obstacle. A whip antenna is connected to a transceiver unit in a radio set housing through a feeder line. A passive element is grounded to the radio set housing through a load impedance element. The whip antenna changes the horizontal directivity pattern in dependence upon the electromagnetic coupling with the passive element. The passive element operates as a wave director or a reflector for the whip antenna in accordance with the value of the load impedance element. When the passive element operates as a wave director, the radiation becomes much stronger in the direction toward the passive element. On the other hand, when the passive element operates as a reflector, the radiation in the direction away from the passive element becomes much stronger.

20 Claims, 11 Drawing Sheets

FIRST PREFERRED EMBODIMENT

FIRST PREFERRED EMBODIMENT

SECOND PREFERRED EMBODIMENT

THIRD PREFERRED EMBODIMENT
EXTENDED STATE OF ANTENNA UNIT 210

THIRD PREFERRED EMBODIMENT
CONTRACTED STATE OF ANTENNA UNIT 210

RADIO ANTENNA DEVICE

TECHNICAL FIELD

The present invention relates to a radio antenna apparatus, and in particular, to a radio antenna apparatus for use in a portable telephone or a mobile telephone for use in mobile communications.

BACKGROUND ART

A radio set comprising a conventionally publicly known radio antenna apparatus is shown in FIG. 17 so as to schematically show an antenna and related parts. The radio set of the prior art is constituted by an external antenna 602 such as a whip antenna or a helical antenna, a built-in antenna 603 such as a plane antenna, feeder lines 604 and 605, a transceiver unit 606 including a transceiver, and a microphone 609 connected to the transceiver unit 606, which are provided in a radio set housing 601. The external antenna 602 and the built-in antenna 603 are arranged in proximity to each other so as to be electromagnetically coupled with each other, constitute a receiving space selective diversity antenna. The external antenna 602 is arranged so as to be electrically insulated from the radio set housing 601, while a predetermined point of the built-in antenna 603 is grounded to the radio set housing 601 through a short-circuiting line 603*a*, and the built-in antenna 603 constitutes an inverted-F antenna.

When a power is supplied to the external antenna 602, a switch 607 is turned on so that the external antenna 602 is connected to the transceiver unit 606 provided in the radio set housing 601 through the feeder line 604. At the same time, the switch 608 is turned off, and the feeder line 605 connected to the built-in antenna 603 is disconnected from the transceiver unit 606.

On the other hand, When the built-in antenna 603 is supplied with power, the switch 608 is turned on so that the built-in antenna 603 is connected to the transceiver unit 606 through the feeder line 605. At the same time, the switch 607 is turned off so that the feeder line 604 connected to the external antenna 602 is disconnected from the transceiver unit 606.

In the radio set comprising the conventional radio antenna apparatus described above, the external antenna 602 and the built-in antenna 603 are designed to have a high gain primarily in a free space, and have a uniform horizontal plane directivity or radiation pattern along the x-y plane with a center of the external antenna 602 and the built-in antenna 603. In other words, as shown in FIG. 17, in the case where the orthogonal coordinates are set so that the z-axis direction is coincident with the axial direction of the external antenna 602 and the x-axis direction is coincident with the direction of the normal to the built-in antenna 603, the horizontal plane directivity pattern of the antenna of the conventional radio set in a free space is shown in FIG. 18, and it has a shape of a circle (as indicated by a thick solid line of FIG. 18) with the center of the z-axis on the x-y plane, as shown in FIG. 18. It is to be noted that the microphone 108 is arranged under the radio set housing 101 on the side nearer to the whip antenna 102 in the x-axis direction.

The conventional radio antenna apparatus described above has the same horizontal plane directivity pattern in the x-y plane and hence a horizontal plane non-directivity pattern. Therefore, in a case where a human head or the like obstacle approaching the microphone 609 exists in proximity to the radio set comprising the conventional radio antenna apparatus described above, the radio wave is interrupted by the obstacle, and this leads to a problem of gain deterioration.

An object of the present invention is to solve the above-mentioned problems and to provide a radio antenna apparatus, in which the horizontal plane directivity pattern of the antenna is changed in a direction not affected by an obstacle, and radio wave interference by the obstacle is reduced so as to improve a radiation efficiency thereof.

SUMMARY OF THE INVENTION

According to the present invention, there is provided a radio antenna apparatus connected to a transceiver unit of a radio set, comprising an antenna element, a passive element arranged in proximity to the antenna element so as to be electromagnetically coupled with the antenna element, a load impedance element, connected to the passive element, and capable of changing an impedance value thereof, and control means for changing a directivity pattern of the antenna element by changing the impedance value of the load impedance element.

Also, the above-mentioned radio antenna apparatus preferably further comprises an impedance matching circuit, connected between the antenna element and the transceiver unit of the radio set, for matching the impedance of the antenna element with the impedance of the transceiver unit of the radio set.

Also, according to a radio antenna apparatus of the present invention, there is provided a radio antenna apparatus connected to the transceiver unit of a radio set, comprising at least two antenna elements including first and second antenna elements arranged close enough to each other so as to be electromagnetically coupled with each other and constituting a space selective diversity antenna, a load impedance element capable of changing an impedance value thereof, first switching means for selectively switching over so as to connect one of the first and second antenna elements to the transceiver unit of the radio set, and to connect another one thereof to the load impedance element, and control means for changing a directivity pattern of the antenna element by changing the impedance value of the load impedance element.

Further, the above-mentioned radio antenna preferably further comprises an impedance matching circuit, connected between the first or second antenna element connected to the transceiver unit of the radio set, and the transceiver unit of the radio set, for matching the impedance of the antenna element with the impedance of the transceiver unit of the radio set.

Still further, in the above-mentioned radio antenna apparatus, the control means preferably changes a correlation coefficient between the first antenna and the second antenna by changing the value of the load impedance element.

Also, in the above-mentioned radio antenna apparatus, preferably, one of the first and second antennas is at least one of a whip antenna and a helical antenna, and another one of the first and second antennas is a plane antenna.

Further, in the above-mentioned radio antenna apparatus, the control means preferably changes the directivity pattern of the antenna elements by selectively changing the value of the load impedance element between a standby mode and a speech mode of the transceiver unit of the radio set.

Still further, the above-mentioned radio antenna apparatus preferably further comprises first detecting means for detecting a strength of a received signal received by the transceiver unit of the radio set, wherein the control means changes the directivity pattern of the antenna elements by changing the value of the load impedance element in accordance with the strength of the received signal detected by the first detecting means at a standby mode of the transceiver unit of the radio set.

Also, in the above-mentioned radio antenna apparatus, the load impedance element preferably includes an impedance variable element.

Further, in the above-mentioned radio antenna apparatus, the load impedance element preferably includes a reactance element.

Still further, in the above-mentioned radio antenna apparatus, the load impedance element preferably includes a plurality of impedance elements, and second switching means for selectively switching the plurality of the impedance elements, wherein the control means changes the value of the load impedance element by controlling the switching of the second switching means.

Also, in the above-mentioned radio antenna apparatus, the impedance matching circuit preferably includes a plurality of impedance matching circuit units, and third switching means for selectively switching the plurality of the impedance matching circuit units.

Further, the above-mentioned radio antenna apparatus preferably further comprises second detecting means for detecting a supplied power supplied to the antenna element, wherein the control means matches the impedance of the antenna elements with the impedance of the transceiver unit of the radio set by controlling the impedance matching circuit so as to maximize the supplied power detected by the second detecting means.

BEST MODE FOR CARRYING OUT THE INVENTION

Preferred embodiments of the present invention will be described below with reference to the accompanying drawings.

FIRST PREFERRED EMBODIMENT

Figure 1:
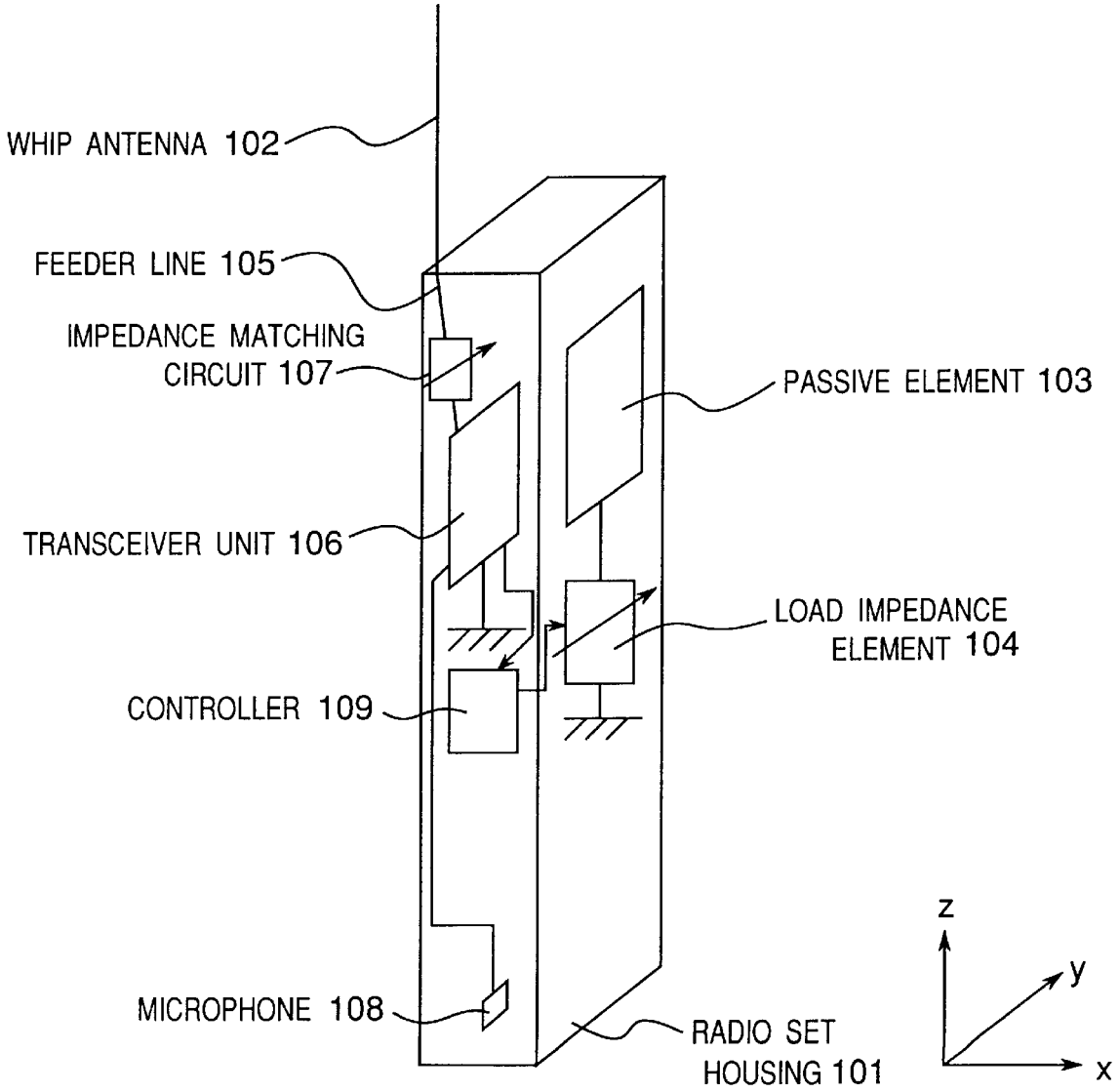
FIG. 1 is a perspective view showing a configuration of a radio set comprising a radio antenna apparatus according to a first preferred embodiment of the present invention.

FIG. 1 shows a radio set comprising a radio antenna apparatus according to a first preferred embodiment of the present invention, so as to schematically show an antenna and related parts. The radio set according to the first preferred embodiment of the present invention is constituted within a radio set housing 101 and comprises a whip antenna 102, a passive or parasitic element 103, a load impedance element 104, a feeder line 105, a transceiver unit 106 including a transceiver, an impedance matching circuit 107, a microphone 108 connected to the transceiver unit 106, and a controller 109 connected to the transceiver unit 106 and the load impedance element 104. It is to be noted that the microphone 108 is arranged under the radio set housing 101 on the side nearer to the whip antenna 102 along the x-axis direction of FIG. 1.

Figure 17:
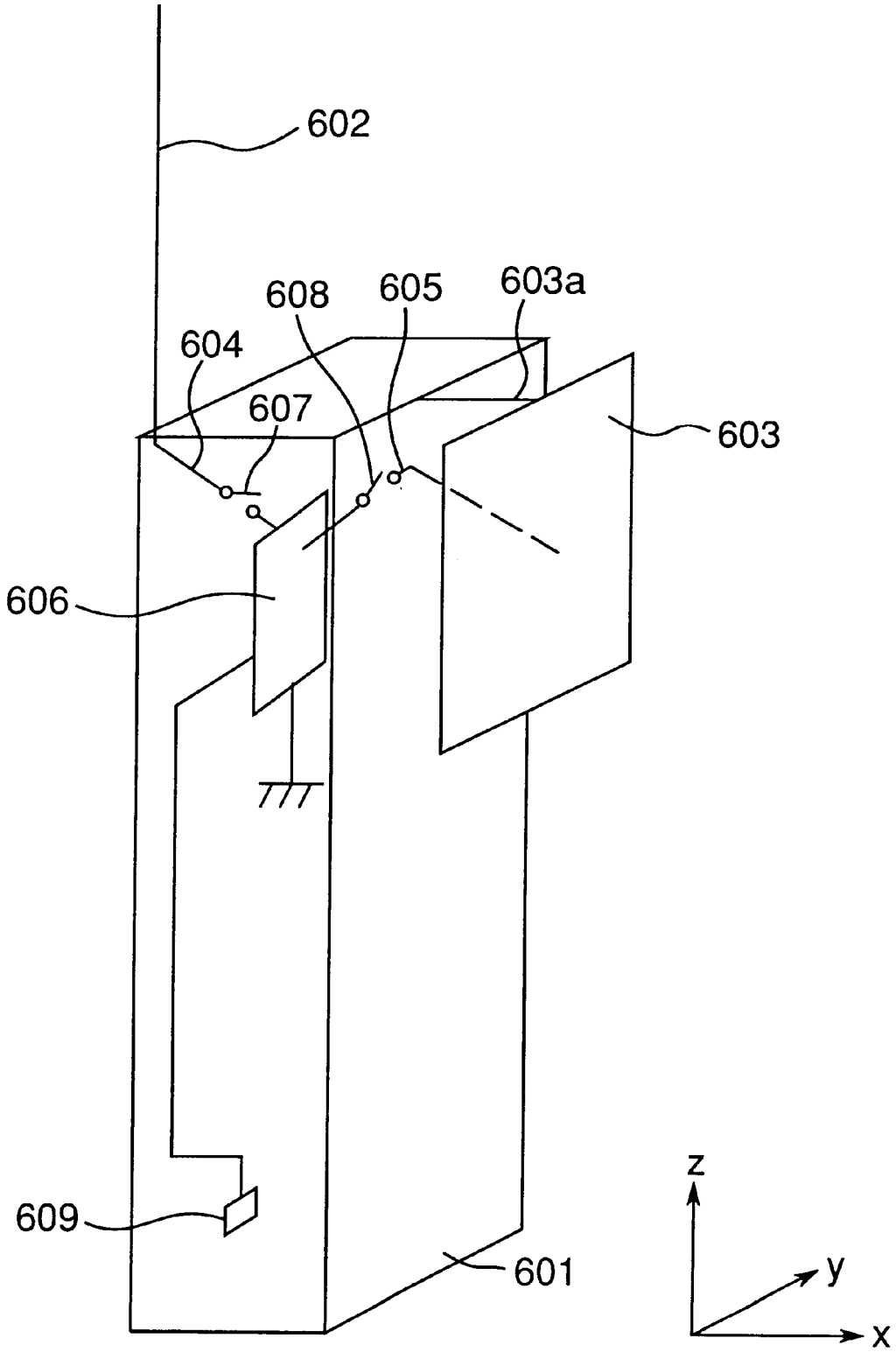
Fig.17 PRIOR ART
FIG. 17 is a perspective view showing a configuration of a radio set comprising a conventional radio antenna apparatus.
Figure 18:
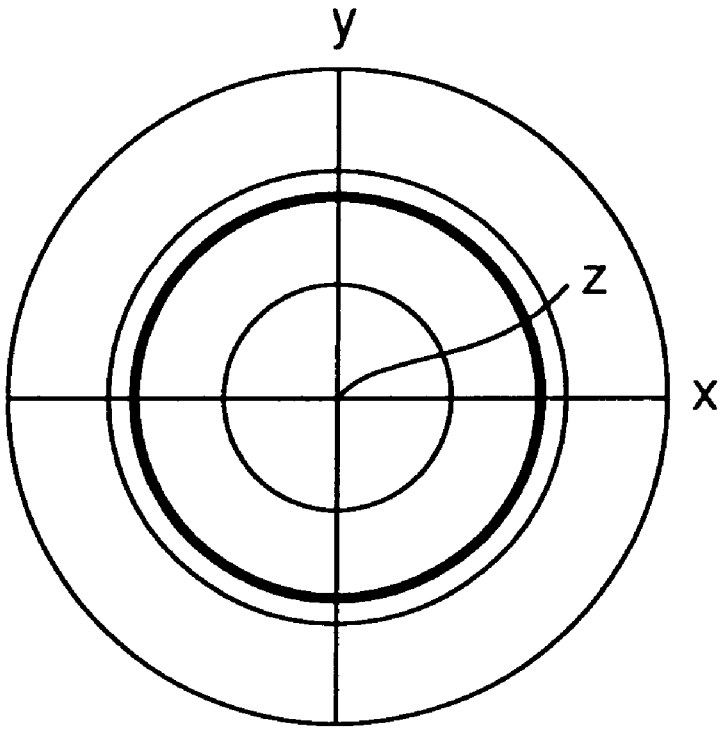
Fig.18 PRIOR ART
FIG. 18 is a diagram showing an example of a horizontal plane directivity pattern of the radio antenna apparatus of FIG. 17.

Referring to FIG. 1, the whip antenna 102 and the passive (no-power-supplied) element 103 making up a plane antenna are arranged so as to be electromagnetically coupled with each other and to be electrically isolated from the radio set housing 101. In this case, in a manner similar to that of the prior art shown in FIG. 17, a predetermined point of the passive element 103 may be grounded to the radio set housing 101 through a short-circuiting line (not shown), and then, the passive element 103 constitutes an inverted-F antenna. The whip antenna 102 is connected to the transceiver unit 106 provided in the radio set housing 101, through the feeder line 105 and the impedance matching circuit 107. Also, the passive element 103 is grounded to the radio set housing 101 through the load impedance element 104.

The impedance matching circuit 107 is a circuit for matching an impedance of the whip antenna 102 with an impedance of the transceiver unit 106. Concretely speaking, the impedance matching circuit 107 is constituted by a circuit shown in one of FIGS. 10 to 12, for example.

Figure 10:
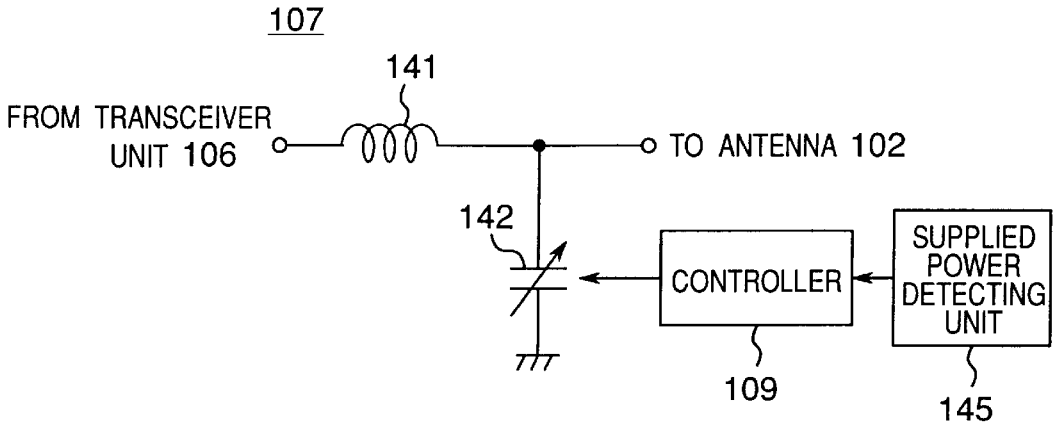
FIG. 10 is a circuit diagram showing a first modified preferred embodiment of the impedance matching circuit of FIG. 1.

The impedance matching circuit 107 of FIG. 10 is constituted by an L-shaped circuit comprising an inductor 141, and a variable capacitor of a trimmer capacitor 142 with one terminal thereof grounded. A supplied power detecting unit 145 detects a power supplied from the transceiver unit 106 through the impedance matching circuit 107 to the whip antenna 102, and outputs the detected power to the controller 109. In response thereto, the controller 109 changes the electrostatic capacitance of the variable capacitor 142 to maximize the detected supplied power, so that the impedance of the whip antenna 102 is matched with the impedance of the transceiver unit 106.

Figure 11:
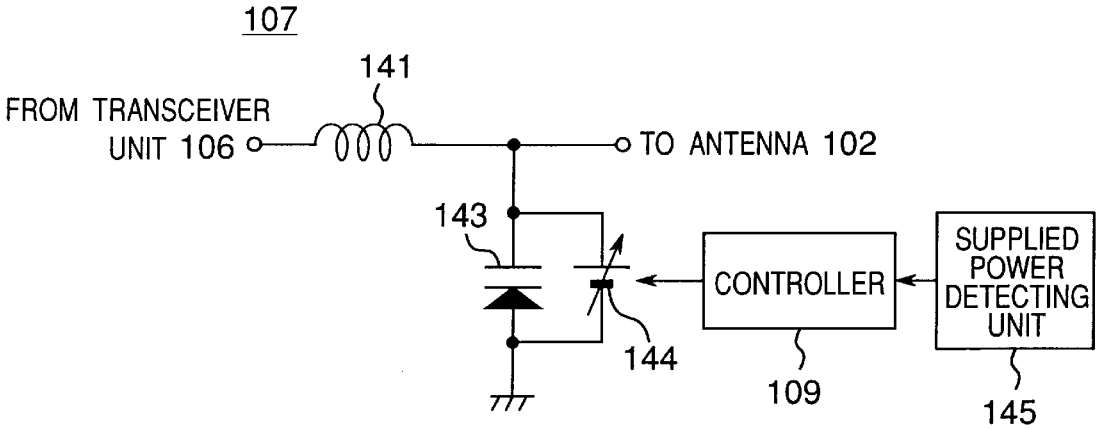
FIG. 11 is a circuit diagram showing a second modified preferred embodiment of the impedance matching circuit of FIG. 1.

As compared with the impedance matching circuit 107 of FIG. 10, the impedance matching circuit 107 of FIG. 11 has such a feature that the variable capacitor 142 is replaced with a parallel circuit including a variable capacitance diode 143 and a variable voltage DC power supply 144 for applying a reverse bias voltage Vb to the variable capacitance diode 143. The controller 109 changes the reverse bias voltage Vb of the variable voltage DC power supply 144 so as to maximize the detected supplied power, and then, this leads to that the electrostatic capacitance of the variable capacitor 142 changes so as to match the impedance of the whip antenna 102 with the impedance of the transceiver unit 106.

Figure 12:
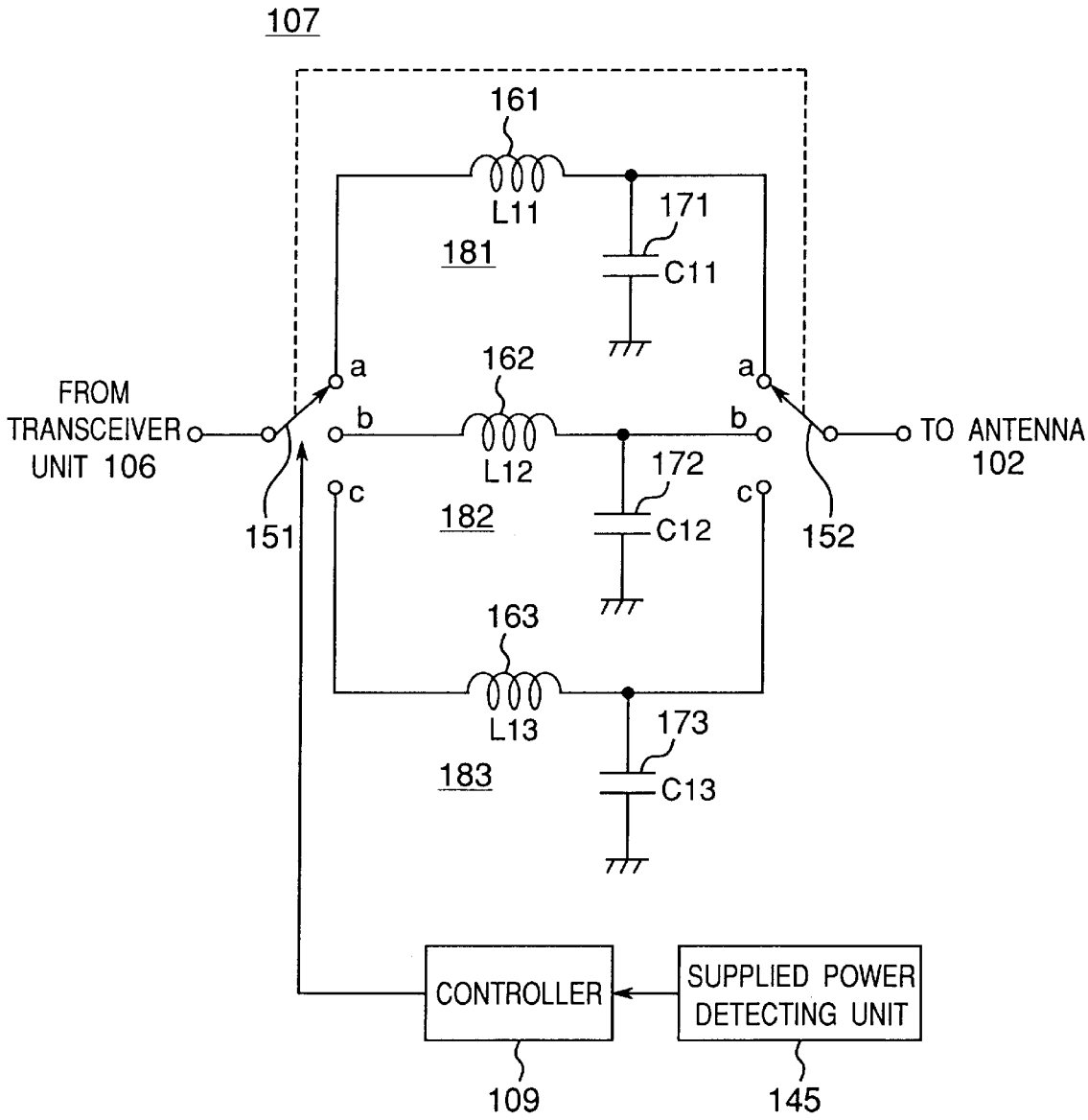
FIG. 12 is a circuit diagram showing a third modified preferred embodiment of the impedance matching circuit of FIG. 1.

The impedance matching circuit 107 of FIG. 12 comprises three L-shaped circuits 181, 182 and 183, each having a configuration similar to that of the impedance matching circuit of FIG. 10, and each having different output impedance on the side nearer to the antenna 102 from each other, and the impedance matching circuit 107 further comprises switches 151 and 152 for selectively switching the three L-shaped circuits in operatively interlocked relation with each other. In this case, the L-shaped circuit 181 is constituted by an L-shaped circuit comprising an inductor 161 having an inductance L11 and a capacitor 171 having an electrostatic capacitance C11. Also, the L-shaped circuit 182 is constituted by an L-shaped circuit comprising an inductor 162 having an inductance L12 and a capacitor 172 having an electrostatic capacitance C12. Further, the L-shaped circuit 183 is constituted by an L-shaped circuit comprising an inductor 163 having an inductance L13 and a capacitor 173 having an electrostatic capacitance C13. In this case, the controller 109 selectively switches over between the switches 151 and 152 in operatively interlocked relation to each other so as to maximize the supplied power detected, so that the impedance of the whip antenna 102 is substantially matched with the impedance of the transceiver unit 106.

Figure 5:
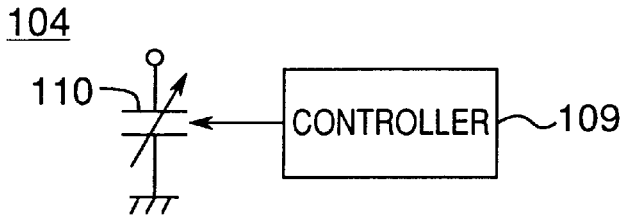
FIG. 5 is a circuit diagram showing a first modified preferred embodiment in which a load impedance element of FIG. 1 is constituted by a variable capacitor.

According to the present preferred embodiment, the load impedance element 104 preferably includes a reactance component, and in this case, as shown in FIG. 5, the load impedance element 104 is of a variable capacitor 110 of a trimmer or variable capacitor with one terminal thereof grounded. By changing the value of the variable capacitor 110 under the control of the controller 109, namely, by changing the electrical length of the passive element 103 including the load impedance element 104 as compared with the electrical length of the whip antenna 102, the horizontal plane directivity or radiation pattern is changed. Also, the following configuration can be employed in place of the variable capacitor 110 of FIG. 5.

Figure 6:
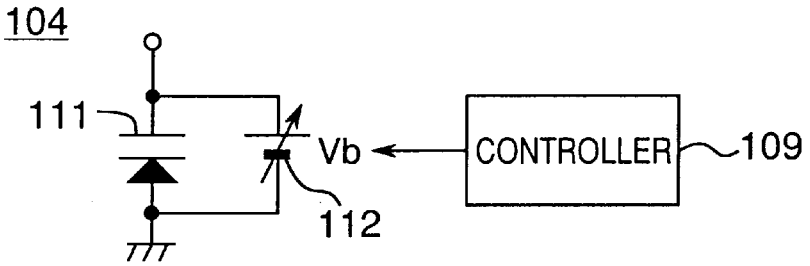
FIG. 6 is a circuit diagram showing a second modified preferred embodiment in which the load impedance element of FIG. 1 is constituted by a variable capacitance diode.

(a) The load impedance element 104, as shown in FIG. 6, is constituted by a parallel circuit including a variable capacitance diode 111 and a variable voltage DC power supply 112 for applying a reverse bias voltage Vb to the variable capacitance diode 111. In this case, the controller 109 changes the horizontal plane directivity pattern, as described in detail, by changing the reverse bias voltage Vb of the variable voltage DC power supply 112 and thus changing the electrostatic capacitance of the variable capacitance diode 111.

Figure 7:
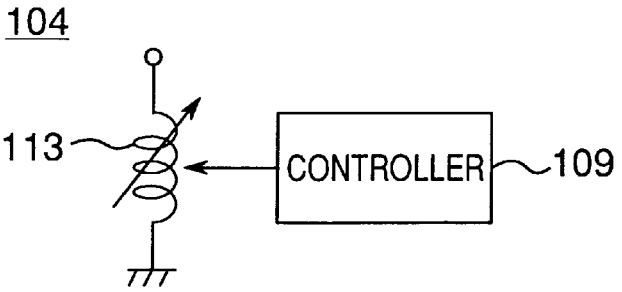
FIG. 7 is a circuit diagram showing a third modified preferred embodiment in which the load impedance element of FIG. 1 is constituted by a variable inductor.

(b) As shown in FIG. 7, the horizontal plane directivity pattern is changed, as described in detail later, by changing the inductance value of the variable inductor 113 under the control of the controller 109.

Figure 8:
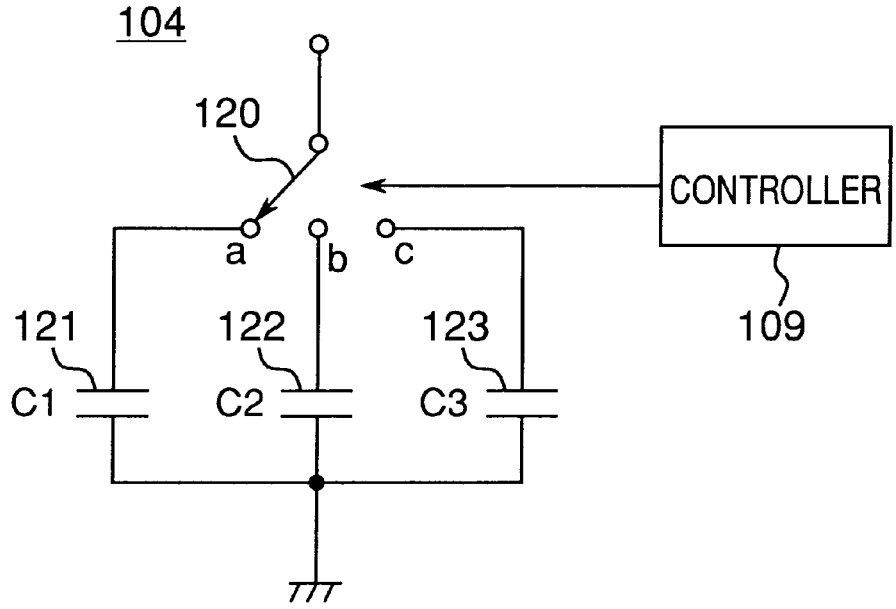
FIG. 8 is a circuit diagram showing a fourth modified preferred embodiment in which the load impedance element of FIG. 1 is constituted by a circuit for switching three capacitors having different electrostatic capacitances using a switch.

(c) As shown in FIG. 8, the horizontal plane directivity pattern is changed, as described in detail later, by selectively switching among the capacitors 121, 122 and 123 with one terminal grounded and having different electrostatic capacitances C1, C2 and C3, respectively, by the switch 120, so as to change the electrostatic capacitance value under the control of the controller 109.

Figure 9:
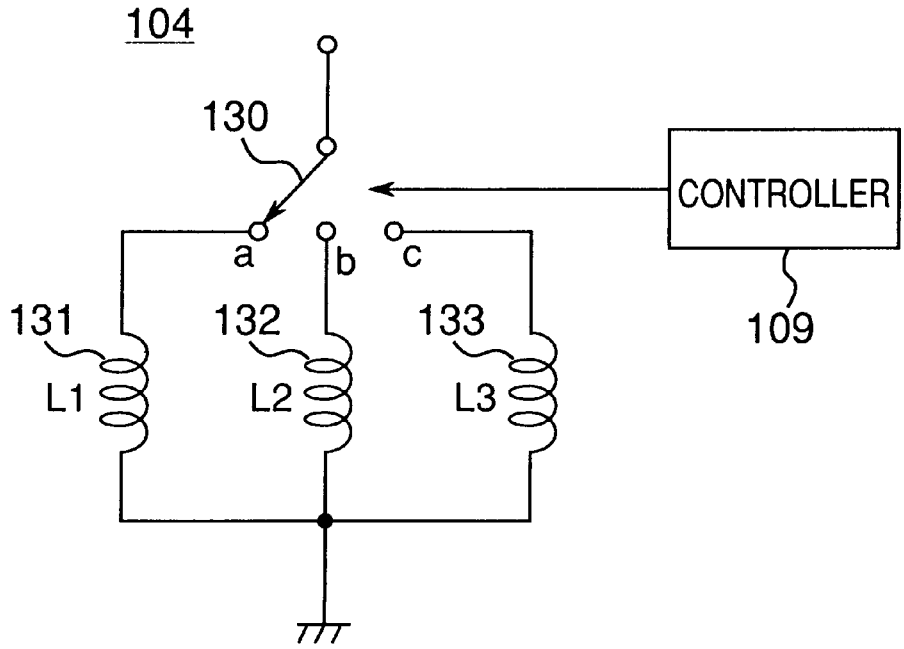
FIG. 9 is a circuit diagram showing a fifth modified preferred embodiment in which the load impedance element of FIG. 1 is constituted by a circuit for switching three inductors of different inductance using a switch.

(d) As shown in FIG. 9, the horizontal plane directivity pattern is changed, as described in detail later, by selectively switching the inductors 131, 132 and 133 of a coil with one terminal grounded and having different inductance values L1, L2 and L3, respectively, by the switch 130, so as to change the inductance value under the control of the controller 109.

In the first preferred embodiment shown in FIG. 1, one end of the load impedance element 104 is grounded, however, the present invention is not limited to this. The end of the load impedance element 104 may be in an open state.

In addition, the horizontal plane directivity pattern of the whip antenna 102 is changed in dependence upon the electromagnetic coupling with the passive element 103. Namely, the passive element 103 functions as a wave director or a reflector for the whip antenna 102 in dependence on the value of the load impedance element 104 connected to the passive element 103. For example, in the case where the load impedance element 104 has a comparatively large electrostatic capacitance and the electrical length of the passive element 103 including the load impedance element 104 is shorter than the electrical length of the whip antenna 102, the passive element 103 functions as a wave director, and the radiation toward the passive element 103 becomes much stronger. On the other hand, in the case where the load impedance element 104 has a comparatively large inductance and the electrical length of the passive element 103 including the load impedance element 104 is longer than the electrical length of the whip antenna 102, the passive element 103 functions as a reflector, and the radiation in the direction opposite to the direction toward the passive element 103 becomes much stronger.

Figure 13:
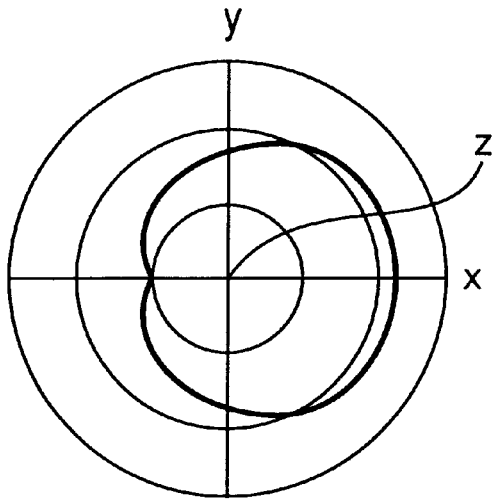
FIG. 13 is a diagram showing an example of a horizontal plane directivity pattern of the radio antenna apparatus of FIGS. 1, 2 and 3.
Figure 14:
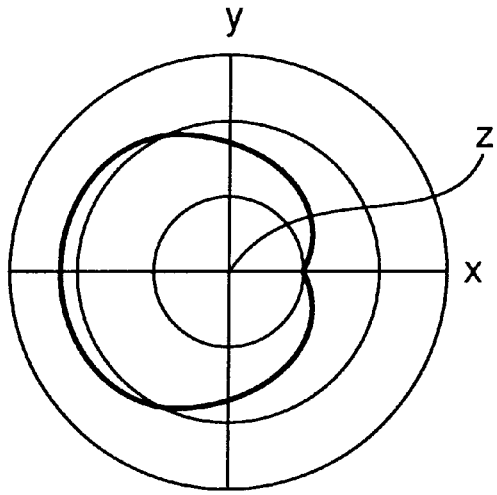
FIG. 14 is a diagram showing another example of a horizontal plane directivity pattern of the radio antenna apparatus of FIGS. 1, 2 and 3.

As a result, as shown in FIG. 1, in the case where orthogonal coordinates are set so that the z-axis direction is coincident with the axial direction of the antenna 102 and the x-axis direction is coincident with the direction of the normal to the passive element 103, the horizontal plane directivity pattern of the antenna 102 in a free space as shown by a thick solid line in FIG. 13 is realized when the passive element 103 functions as a wave director. On the other hand, when the passive element 103 functions as a reflector, the horizontal plane directivity pattern indicated by the thick solid line in FIG. 14 is realized. Also, in the case where the electrical length of the passive element 103 including the load impedance element 104 is substantially the same as the electrical length of the whip antenna 102, the horizontal plane directivity pattern of the whip antenna 102 is almost non-directional (or substantially non-directional pattern) as shown in FIG. 15 as the result of electromagnetic coupling with the passive element 103.

Figure 15:
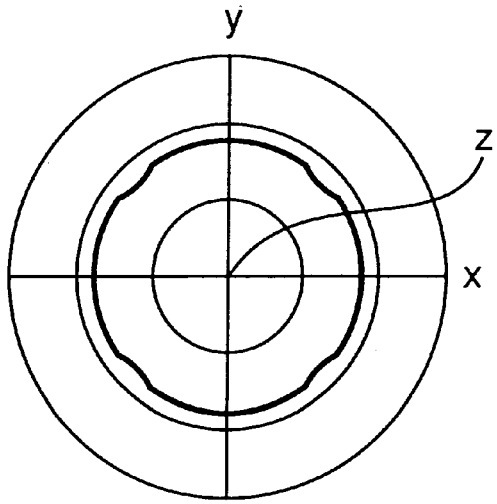
FIG. 15 is a diagram showing still another example of a horizontal plane directivity pattern of the radio antenna apparatus of FIGS. 1, 2 and 3.

While the transceiver unit 106 of the radio set is not in a speaking state, or busy state but in standby state communicating with the base station for position registration or the like, the controller 109 controls the horizontal plane directivity pattern to be that shown in FIG. 15 by changing the value of the load impedance element 104. On the other hand, in the case where the transceiver unit 106 of the radio set is activated so that the operator is speaking, the controller 109 controls the horizontal plane directivity pattern to be that as shown in FIG. 13, for example. Namely, while the operator is speaking as in the latter case and the head of the operator is located in proximity to the side of the whip antenna 102 in the x-axis direction of the radio set housing 10, the electromagnetic radiation is not directed to an obstacle of the head of the operator, and this leads to reducing the electromagnetic radiation to the operator while at the same time making it possible to reduce the radio wave interference by the particular obstacle. Therefore, even if an obstacle exists in proximity to the radio set in the direction of weakening radiation, the radio interference by such an obstacle can be reduced, so as to improve the radio wave radiation efficiency when an obstacle is in proximity to the radio set.

In the first preferred embodiment described above, a polarization diversity is also constituted by two antennas 102 and 103 having different polarizations.

In the preferred embodiment described above, a capacitor or an inductor is used as the load impedance element 104. Alternatively, a distributed constant line such as a microstrip line, a coplanar line or the like can be used as the load impedance element. When using the distributed constant line, a similar effect can be obtained by setting a load impedance element based on the termination conditions and the line length.

In the preferred embodiment described above, the value of the load impedance element 104 can be easily changed as shown in FIGS. 5 to 9, for example, and this leads to a result in which the directivity pattern of the radio set comprising the radio antenna apparatus according to the present preferred embodiment can be changed arbitrarily.

The preferred embodiment described above includes only one set of the passive element 103 and the load impedance element 104 connected to the passive element 103, however, the present invention is not limited to this. Two or more sets of the passive element 103 and the load impedance element 104 can be provided.

SECOND PREFERRED EMBODIMENT

Figure 2:
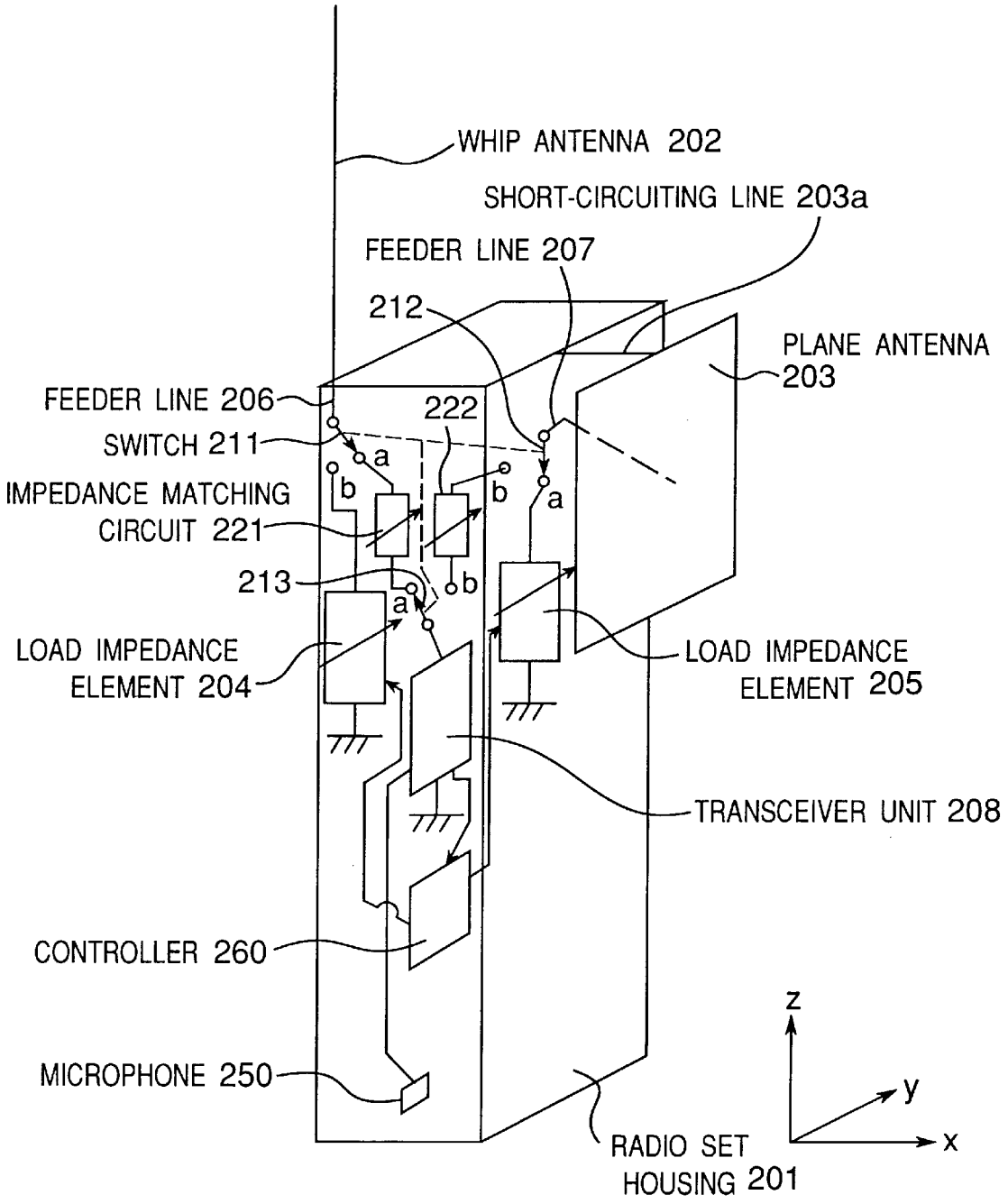
FIG. 2 is a perspective view showing a configuration of a radio set comprising a radio antenna apparatus according to a second preferred embodiment of the present invention.

FIG. 2 shows a radio set comprising a radio antenna apparatus according to the second preferred embodiment of the present invention, so as to schematically show an antenna and related parts. The radio set of the second preferred embodiment is constituted within a radio set housing 201 and comprises a whip antenna 202, a plane antenna 203, load impedance elements 204 and 205, feeder lines 206 and 207, a transceiver unit 208 having a transceiver, switches 211, 212 and 213, impedance matching circuits 221 and 222, a microphone 250 connected to the transceiver unit 208, and a controller 260 connected to the transceiver unit 208 and the load impedance elements 204 and 205. The microphone 250 is arranged under the radio set housing 201 on the side nearer to the whip antenna 202 in the x-axis direction as shown in FIG. 1.

Referring to FIG. 2, the whip antenna 202 and the plane antenna 203 are arranged so as to be electromagnetically coupled with each other and to be electrically insulated from the radio set housing 201. The plane antenna 203 constitutes an inverted-F antenna with a predetermined point thereof grounded to the radio set housing 201 through a short-circuiting line (not shown).

The whip antenna 202 is connected to the transceiver unit 208 provided in the radio set housing 201 through the feeder line 206, a contact "a" of the switch 211, the impedance matching circuit 221, and a contact "a" of the switch 213. The whip antenna 202 is grounded to the radio set housing 201 through the feeder line 206, a contact "b" of the switch 211 and the load impedance element 204. Also, the plane antenna 203 is grounded through the feeder line 207, a contact "a" of the switch 212 and the load impedance element 205, and the plane antenna 203 is connected to the transceiver unit 208 through the feeder line 207, a contact "b" of the switch 212, the impedance matching circuit 222, and a contact "b" of the switch 213.

In the present preferred embodiment, the load impedance elements 204 and 205 are each preferably constituted of a reactance component, and in a manner similar to that of the first preferred embodiment, for example, they can each be the load impedance element shown in any one of FIGS. 5 to 9. Also, in the present preferred embodiment, the impedance matching circuits 221 and 222 can be the impedance matching circuit shown in any one of FIGS. 10 to 12, for example, in a manner similar to that of the first preferred embodiment.

In the radio antenna apparatus shown in FIG. 2, the whip antenna 202 and the plane antenna 203 constituting an inverted-F antenna are arranged so as to be electromagnetically coupled with each other and make up a space selective diversity antenna. When the whip antenna 202 is supplied with power from the transceiver unit 208, the switches 211, 212 and 213 are switched over to the contact "a" thereof under the control of the controller 260. At the same time, the whip antenna 202 is connected to the transceiver unit 208 through the impedance matching circuit 221, while the plane antenna 203 is connected to the load impedance element 205. On the other hand, when the power is supplied to the plane antenna 203 from the transceiver unit 208, the switches 211, 212 and 213 are switched over to the contact "b" thereof under the control of the controller 260. At the same time, the plane antenna 203 is connected to the transceiver unit 208 through the impedance matching circuit 222, while the whip antenna 202 is connected to the load impedance element 204.

In the radio antenna apparatus configured as described above, when the whip antenna 202 is supplied with power, the whip antenna 202 changes the horizontal plane directivity pattern thereof in dependence on the electromagnetic coupling with the plane antenna 203. Then, the plane antenna 203 functions as a wave director or reflector for the whip antenna 202 according to the value of the load impedance element 205. In the case where the electrical length of the plane antenna 203 including the load impedance element 205 is shorter than the electrical length of the whip antenna 202 and the plane antenna 203 functions as a wave director, the radiation in the direction toward the plane antenna 203 becomes much stronger as shown in FIG. 13. On the other hand, in the case where the electrical length of the plane antenna 203 including the load impedance element 205 is longer than the electrical length of the whip antenna 202 and the plane antenna 203 functions as a reflector, the radiation becomes much stronger in the direction toward the whip antenna 202 as shown in FIG. 14.

In a manner similar to that of above, when the plane antenna 203 is supplied with power, the horizontal plane directivity pattern of the plane antenna 203 changes in dependence on the electromagnetic coupling with the whip antenna 202. At the same time, the whip antenna 202 functions as a wave director or a reflector for the plane antenna 203 according to the value of the load impedance element 204. In the case where the electrical length of the whip antenna 202 including the load impedance element 204 is shorter than the electrical length of the plane antenna 203 and the whip antenna 202 functions as a wave director, as shown in FIG. 14, the radiation becomes much stronger in the direction toward the whip antenna 202. On the other hand, in the case where the electrical length of the whip antenna 202 including the load impedance element 204 is longer than the electrical length of he plane antenna 203 and the whip antenna 202 functions as reflector, as shown in FIG. 13, the radiation becomes much stronger in the direction toward the plane antenna 203.

As a result, as shown in FIG. 2, when the orthogonal coordinates are set so that the z-axis direction is coincident with the axial direction of the whip antenna 202 and the x-axis direction is coincident with the direction of the normal to the plane antenna 203, the horizontal plane directivity pattern of the radio antenna apparatus in the free space is similar to that described in the first preferred embodiment. Thus, even in the presence of an obstacle in the vicinity of the radio set in the direction of a weakening radiation, the radio wave interference by such an obstacle can be reduced, and therefore, the radio wave radiation efficiency can be improved with an obstacle located in the vicinity of the radio set.

In the case where the transceiver unit 208 of the radio set is not in a speaking or busy state, but in standby state only communicating with the base station for position registration or the like, the controller 260 controls the horizontal plane directivity pattern to be that as shown in FIG. 15, for example, by changing the value of the load impedance element 204 or 205. On the other hand, in the case where the transceiver unit 208 of the radio set is occupied in a speaking or busy state by the operator, the controller 260 controls the horizontal plane directivity pattern to be that as shown in FIG. 13, for example, by changing the value of the load impedance element 204 or 205. Namely, while in the speaking or busy state when the head of the operator is located in proximity to the whip antenna 202 along the x-axis direction of the radio set housing 201, the electromagnetic wave is not radiated in the direction toward the obstacle of the head of the operator, and this leads to not only a reduction in the electromagnetic radiation to the operator, but also a reduction in the radio wave interference by the obstacle.

Figure 16:
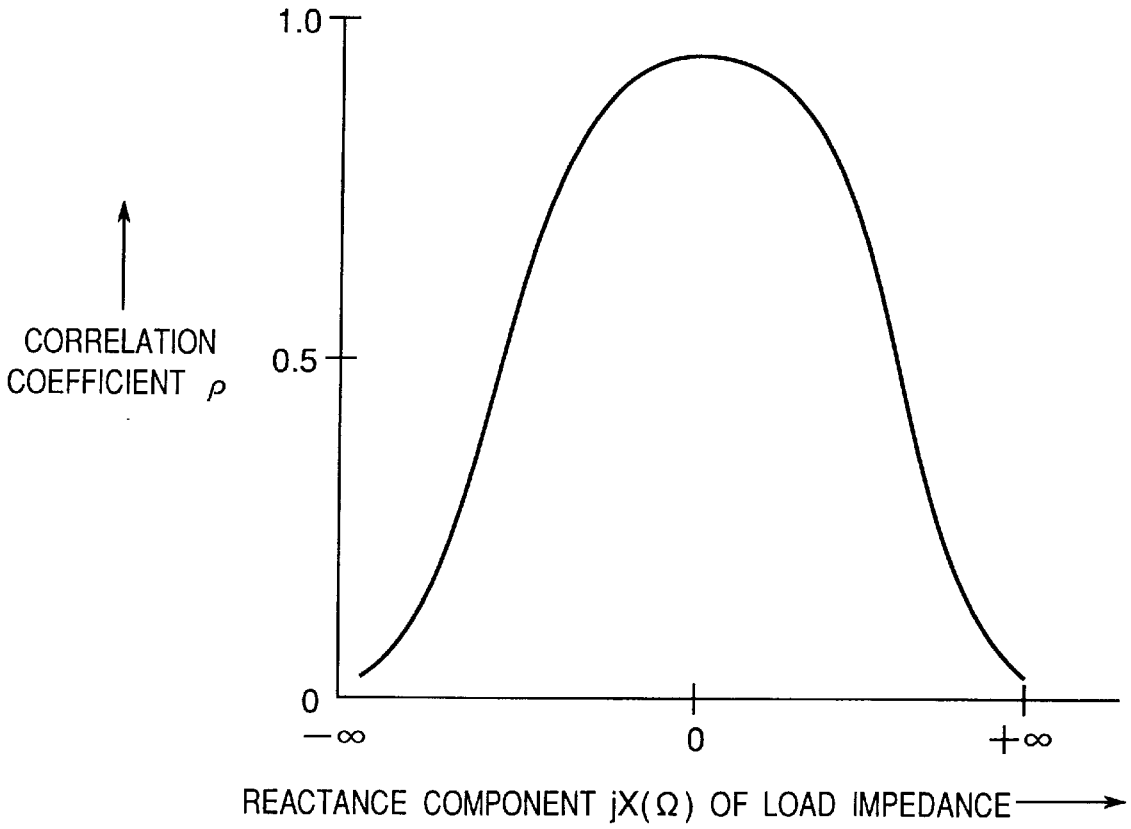
FIG. 16 is a graph showing a change in a correlation coefficient between two antennas making up a space selective diversity antenna, to a reactance component of the load impedance element, in the case of the space selective diversity antenna of FIG. 2.

FIG. 16 is a graph showing a change in a correlation coefficient ρ between the two antennas 202 and 203 making up the space selective diversity antenna of FIG. 2 with respect to the reactance component of the load impedance elements 204 and 205. The correlation coefficient ρ can be expressed as follows:

$$\rho = \frac{\int_{-\pi}^{\pi} G_1^*(\phi)G_2(\phi)P(\phi)e^{-j2\pi d\cos\phi/\lambda}\,d\phi}{\left[\int_{-\pi}^{\pi} G_1^*(\phi)G_1(\phi)P(\phi)\,d\phi \cdot \int_{-\pi}^{\pi} G_2^*(\phi)G_2(\phi)P(\phi)\,d\phi\right]^{1/2}} \quad (1)$$

where $G_i(\phi)$ is a directivity pattern of the antennas 202 and 203 (i=1, i=2), $P(\phi)$ is an angular distribution of the multiple arriving waves, and the exponent term in the numerator on the right side of the equation (1) indicates a phase difference in the arriving wave between the antennas 202 and 203.

As apparent from FIG. 16, when the reactance components of the load impedance elements 204 and 205 are changed, FIG. 16 shows that the correlation coefficient between the two antennas 202 and 203 constituting the space selective diversity antenna can be reduced from the maximum value. In this case, as apparent from the equation (1), the correlation coefficient indicates the degree to which the directivity patterns of the two antennas 202 and 203 are overlapped with each other. The larger the correlation coefficient, the larger the overlapped relation between the directivity patterns, so that the performance as a space selective diversity antenna is deteriorated. On the other hand, the smaller the correlation coefficient, the smaller the overlapped portion of the directivity patterns, so that the performance of the space selective diversity antenna can be improved. In other words, the performance of the space selective diversity antenna can be improved by changing the reactance components of the load impedance elements 204 and 205 so as to reduce the correlation coefficient. According to the second preferred embodiment, the two antennas 202 and 203 having different polarizations also make up a polarization diversity.

In the preferred embodiment described above, the whip antenna 202 and the plane antenna 203 are used as an antennas making up a space selective diversity antenna, however, the present invention is not limited to this. Similar advantageous effects can be obtained even in, for example, a helical antenna, the other linear antennas, a dielectric tip antenna, a spiral plane antenna or the like. Also, similar effects can be obtained with a further increased number of antennas making up a space selective diversity antenna.

The aforementioned configuration of the space selective diversity antenna according to the present preferred embodiment includes one passive plane antenna 203 connected with the load impedance element 205, however, the present invention is not limited to this. Two or more passive antennas each connected with a load impedance element may be provided.

THIRD PREFERRED EMBODIMENT

Figure 3:
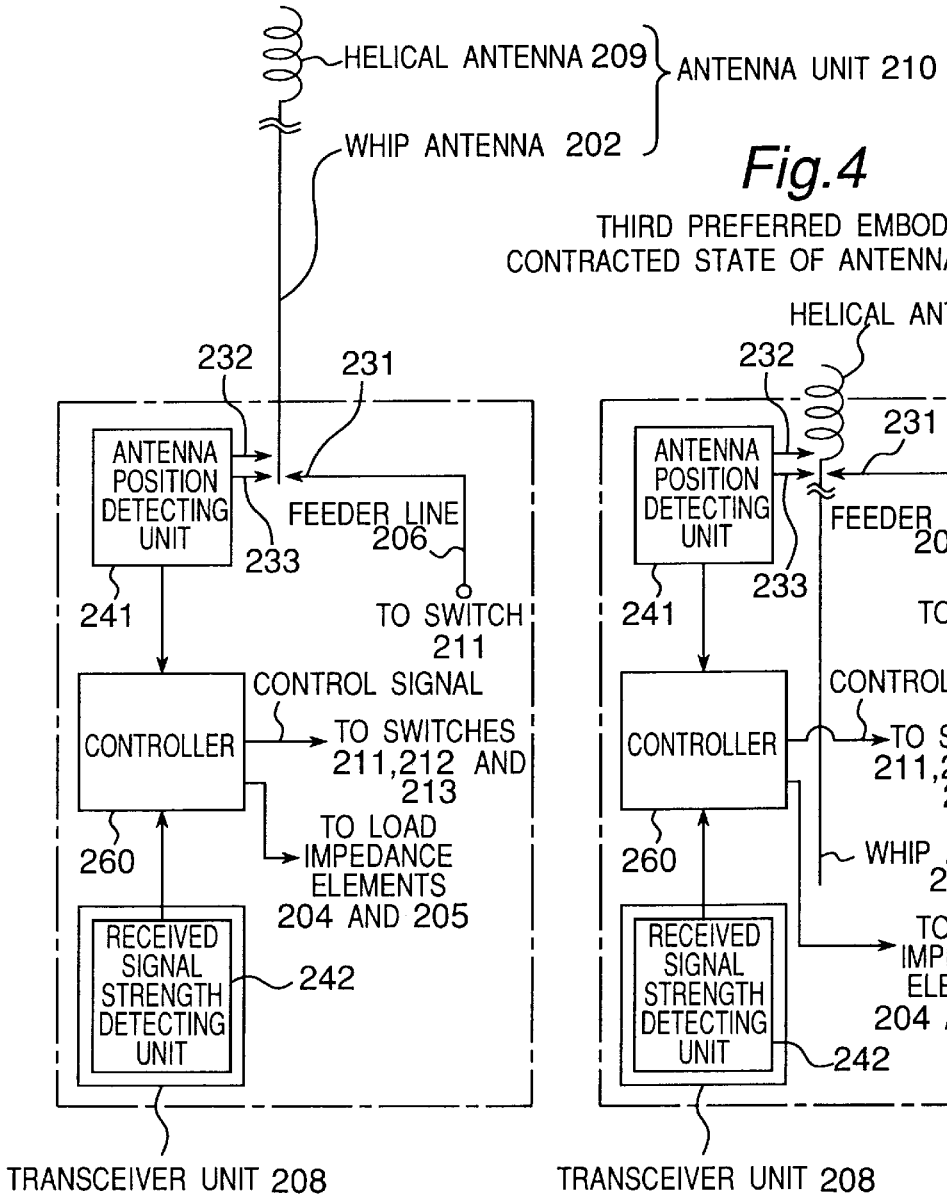
FIG. 3 is a block diagram showing a configuration of a radio set comprising a radio antenna apparatus according to a third preferred embodiment of the present invention, and showing an extended state of an antenna unit.
Figure 4:
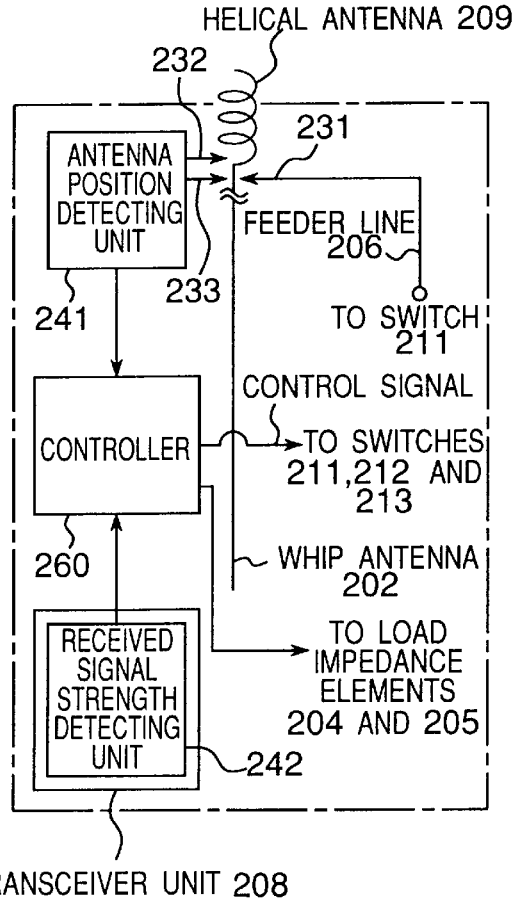
FIG. 4 is a block diagram showing an contracted state of the antenna unit of the radio set of FIG. 3.

FIG. 3 is a block diagram showing a configuration of a radio set comprising a radio antenna apparatus according to a third preferred embodiment of the present invention and shows an extended state of an antenna unit thereof. FIG. 4 is a block diagram showing a contracted state of the antenna unit of the radio set of FIG. 3. In FIGS. 3 and 4, the component parts similar to the corresponding ones in FIG. 2 are designated by the same reference numerals, respectively. The radio set of the third preferred embodiment is different from the radio set of FIG. 2 in the following points.

(a) An antenna unit 210 comprising a helical antenna 209 and a whip antenna 202 is provided in place of the whip antenna 202.

(b) An antenna position detecting unit 233 is further provided for detecting whether the antenna unit 210 is extended or contracted.

(c) The transceiver unit 208 further comprises a received signal strength detecting unit 242 for detecting a strength of a signal received from a base station.

The above-mentioned differences will be described in detail.

The antenna unit 210 is constituted by a helical antenna 209 and a whip antenna 202 which are electrically insulated from each other and longitudinally coupled with each other. The entire longitudinal surface of the whip antenna 202 is formed of an electrical conductor. Also, the surface portion nearer to the whip antenna 202 at one end of a predetermined length of the helical antenna 209 is formed of an electrical conductor, although the other surface portion except for the particular end is formed of an electrically insulating material such as a dielectric material or the like.

Therefore, when the operator speaks and the antenna unit 210 is extended as shown in FIG. 3, the two contacts 232 and 233 connected to the antenna position detecting unit 241 and supported in opposed contact with the surface of the antenna unit 210 are both connected to an electrical conductor formed on the surface of the whip antenna 202, so that the contacts 232 and 233 are short-circuited. On the other hand, the contact 231 is connected to one end of the whip antenna 202, while the whip antenna 202 is connected to the transceiver unit 208 through the contact 231, the feeder line 206 and the switch 211. The short-circuited state between the contacts 232 and 233 is detected by the antenna position detecting unit 241, and the detection signal is outputted to the controller 260. In response thereto, the controller 260 switches over both of the switches 212 and 213 to the contact "a" thereof, for example, while at the same time controlling the horizontal plane directivity pattern to be that as shown in FIG. 13 by changing the value of the load impedance element 205. Namely, while the operator is speaking and the head of the operator is located in proximity to the antenna unit 210 along the x-axis direction, the radio wave is not radiated toward the head of the operator of an obstacle, so that the electromagnetic radiation to the operator can be reduced while at the same time reducing the radio wave interference by the obstacle.

On the other hand, when the operator does not speak and the antenna 210 is contracted in standby state communicating with the base station for position registration as shown in FIG. 4, the contact 233 connected to the antenna position detecting unit 241 is brought into contact with the electrical conductor formed on the surface of the helical antenna 209, while the contact 232 is brought into contact with the electrical insulating member formed on the surface of the helical antenna 209. On the other hand, the contact 231 is connected to one end of the helical antenna 209, and the helical antenna 209 is connected to the transceiver unit 208 through the contact 231, the feeder line 206 and the switch 211. In this case, the contacts 232 and 233 are in a non-conductive state, which state is detected by the antenna position detecting unit 241 and the resulting detection signal is outputted to the controller 260. The controller 260 switches all of the switches 211, 212 and 213 to the contact "a" thereof while at the same time controlling the horizontal plane directivity pattern to be that as shown in FIG. 15 by changing the value of the load impedance element 205.

In addition, when the plane antenna 203 is used, the switches 211, 212 and 213 are switched over to the contact "b" thereof under the control of the controller 260, and the horizontal plane directivity pattern is controlled by changing the value of the load impedance element 204 connected to the whip antenna 202.

Further, when the antenna 210 is contracted and the transceiver unit 208 is in standby state communicating with the base station for position registration or the like as shown in FIG. 4, the received signal strength detecting unit 208 detects, for example, an AGC current of an intermediate frequency amplifier of a receiver provided in the transceiver unit 208, and then, detects the strength of the received signal from the base station, which detection signal is outputted to the controller 260. On the other hand, the controller 260 switches over all of the switches 211, 212 and 213 to the contact "a" thereof, for example, while at the same time controlling the horizontal plane directivity pattern to be that as shown in FIG. 13 or 14, for example, by changing the value of the load impedance element 205 in accordance with the strength of the received signal. Namely, the controller 260 changes the value of the load impedance element 205 so as to maximize the strength of the received signal, for example, this leads to controlling the plane directivity pattern so that the main beam is substantially directed toward the base station.

As described above in detail, a radio antenna apparatus according to the present invention is connected to the transceiver unit of a radio set and comprises an antenna element, a passive element arranged in proximity to the antenna element so as to be electromagnetically coupled to the antenna element, a load impedance element connected to the passive element and capable of changing the impedance value, and control means for changing a directivity pattern of the antenna element by changing an impedance value of the load impedance element.

In other words, the passive element functions as a wave director or a reflector for the antenna in dependence on the value of the load impedance element connected to the passive element, so that when the passive element functions as a wave director, the radiation in the direction toward the passive element becomes much stronger. On the other hand, when the passive element functions as a reflector, the radiation becomes much stronger in the direction opposite to that toward the passive element. Thus, by changing the value of the load impedance element, the directivity pattern of the radio antenna apparatus can be controlled. In the presence of an obstacle nearby, therefore, the radio wave interference due to the obstacle can be reduced by reducing the radiation toward the obstacle, and this leads to an improvement in the radiation efficiency.

Also, a radio antenna apparatus according to the present invention is connected to the transceiver unit of a radio set and comprises at least two antenna elements including first and second antenna elements arranged in such a proximity so as to be electromagnetically coupled with each other and constituting a space selective diversity antenna, a load impedance element capable of changing the impedance value, first switching means for selectively switching over so as to connect one of said first and second antenna elements to the transceiver unit of said radio set, and to connect another one thereof to said load impedance element, and control means for changing a directivity pattern of said antenna element by changing the impedance value of said load impedance element.

In other words, the other antenna, which is passive and separated electrically from the transceiver unit, functions as a wave director or a reflector for one antenna connected to the transceiver unit in dependence on the value of the load impedance element connected to the other antenna. In this case, when the other passive antenna functions as a wave director, the radiation in the direction toward the other passive antenna becomes much stronger. On the other hand, when the other passive antenna functions as a reflector, the radiation in the direction opposite to that toward the passive other antenna becomes much stronger. Therefore, by changing the value of the load impedance element, the directivity pattern of the radio antenna apparatus can be controlled. Accordingly, in the presence of an obstacle nearby, the radiation toward that direction can be reduced so as to reduce the radio wave interference due to the obstacle, and this leads to improvement in the radiation efficiency.

What is claimed is:

1. A radio antenna apparatus to be connected to a transceiver unit of a radio set, comprising:

an antenna element;

a plane-shaped passive element arranged in proximity to said antenna element so as to be electromagnetically coupled with said antenna element;

a load impedance element connected to said passive element, said load impedance element being operable to change an impedance value of said passive element; and a controller operable to change a directivity pattern of said antenna element by changing an impedance value of said load impedance element.

2. A radio antenna apparatus according to claim 1, further comprising an impedance matching circuit connected between said antenna element and the transceiver unit of the radio set, said impedance matching circuit operable to match an impedance of said antenna element with an impedance of the transceiver unit of the radio set.

3. A radio antenna apparatus according to claim 1, wherein said controller is operable to change the directivity pattern of said antenna element by selectively changing the impedance value of said load impedance element based on whether the transceiver unit of the radio set is in a standby mode or a speech mode.

4. A radio antenna apparatus according to claim 1, further comprising a first detector operable to detect a strength of a received signal received by the transceiver unit of the radio set, wherein said controller is operable to change the directivity pattern of said antenna element by changing the impedance value of said load impedance element in accordance with the strength of the received signal detected by said first detector while the transceiver unit of the radio set is in a standby mode.

5. A radio antenna apparatus according to claim 1, wherein said load impedance element comprises an impedance variable element.

6. A radio antenna apparatus according to claim 1, wherein said load impedance element comprises a reactance element.

7. A radio antenna apparatus according to claim 1, wherein said load impedance element comprises:

a plurality of load impedance elements; and a switching device operable to selectively switch between said plurality of load impedance elements, wherein said controller is operable to change the impedance value of said load impedance element by controlling the switching of said switching device.

8. A radio antenna apparatus according to claim 1, further comprising:

an impedance matching circuit connected between said antenna element and the transceiver unit, said impedance matching circuit comprising a plurality of impedance matching circuit units; and a switching device operable to selectively switch between said plurality of impedance matching circuit units.

9. A radio antenna apparatus according to claim 1, further comprising:

an impedance matching circuit connected between said antenna element and the transceiver unit; and a detector operable to detect a supplied power supplied to said antenna element, wherein said controller is operable to match the impedance of the transceiver unit of the radio set by controlling said impedance matching circuit so as to maximize the supplied power detected by said detector.

10. A radio antenna apparatus to be connected to a transceiver unit of a radio set, said radio antenna apparatus comprising:

at least two antenna elements including first and second antenna elements constituting a space selective diversity antenna arranged so as to be electromagnetically coupled to each other, wherein said second antenna element comprises a plane-shaped antenna;

a load impedance element operable to change an impedance value of said at least two antenna elements;

a first switch device operable to selectively connect one of said at least two antenna elements with the transceiver unit of the radio set and another of said at least two antenna elements with said load impedance element; and a controller operable to change a directivity pattern of said at least two antenna elements by changing an impedance value of said load impedance element.

11. A radio antenna apparatus according to claim 3, further comprising an impedance matching circuit connected between said one of said at least two antenna elements and the transceiver unit of the radio set, said impedance matching circuit operable to match an impedance of said one of said at least two antenna elements and an impedance of the transceiver unit of the radio set.

12. A radio antenna apparatus according to claim 10, wherein said controller is operable to change a correlation coefficient between said first antenna element and said second antenna element by changing the impedance value of said load impedance element.

13. A radio antenna apparatus according to claim 10, wherein said first antenna element is at least one of a whip antenna and a helical antenna.

14. A radio antenna apparatus according to claim 10, wherein said controller is operable to change the directivity pattern of said at least two antenna elements by selectively changing the impedance value of said load impedance element based on whether the transceiver unit of the radio is in a standby mode or a speech mode.

15. A radio antenna apparatus according to claim 10, further comprising a first detector operable to detect a strength of a received signal received by the transceiver unit of the radio set, wherein said controller is operable to change the directivity pattern of said at least two antenna elements by changing the impedance value of said load impedance element in accordance with the strength of the received signal detected by said first detector while said the transceiver unit of the radio set is in a standby mode.

16. A radio antenna apparatus according to claim 10, wherein said load impedance element comprises an impedance variable element.

17. A radio antenna apparatus according to claim 10, wherein said load impedance element comprises a reactance element.

18. A radio antenna apparatus according to claim 10, wherein said load impedance element comprises:

a plurality of load impedance elements; and a switching device operable to selectively switch between said plurality of load impedance elements, wherein said controller is operable to change the impedance value of said load impedance element by controlling the switching of said switching device.

19. A radio antenna apparatus according to claim 10, wherein said impedance matching circuit comprises:

a plurality of impedance matching circuit units; and a switching device operable to selectively switch between said plurality of impedance matching circuit units.

20. A radio antenna apparatus according to claim 10, further comprising a detector operable to detect a supplied power supplied to said antenna element, wherein said controller is operable to match the impedance of the transceiver unit of the radio set by controlling said impedance matching circuit so as to maximize the supplied power detected by said detector.

* * * * *